US005894186A

United States Patent [19]

Matsutani et al.

[11] Patent Number: 5,894,186

[45] Date of Patent: Apr. 13, 1999

[54] SPARK PLUG WITH IGNITING PORTION CHIP COMPOSITION

[75] Inventors: Wataru Matsutani; Koji Okazaki, both of Nagoya, Japan

[73] Assignee: NGK Spark Plug Co., Ltd., Nagoya, Japan

[21] Appl. No.: 08/883,905

[22] Filed: Jun. 27, 1997

[30] Foreign Application Priority Data

Jun. 28, 1996 [JP] Japan ..... 8-188349

[51] Int. Cl.[6] ..... H01T 13/20

[52] U.S. Cl. ..... 313/141; 123/169 EL

[58] Field of Search ..... 313/141; 123/169 EL

[56] References Cited

U.S. PATENT DOCUMENTS 5,461,275 10/1995 Oshima ..... 313/141
5,461,276 10/1995 Matsutani et al. ..... 313/141

FOREIGN PATENT DOCUMENTS 0 635 920 A1 1/1995 European Pat. Off. .
2-186579 7/1990 Japan .
5-54953 3/1993 Japan .
5-54955 3/1993 Japan .
5-159854 6/1993 Japan .
7-37677 2/1995 Japan .
2 299 813 10/1996 United Kingdom .

*Primary Examiner*—Sandra O'Shea
*Assistant Examiner*—Vip Patel
*Attorney, Agent, or Firm*—Morgan, Lewis & Bockius LLP

[57] ABSTRACT

A spark plug includes a central electrode, an insulator exterior to the central electrode, a metallic shell exterior to the insulator and having the central electrode protrude from one end of the metallic shell, a ground electrode having one end coupled to the metallic shell and having another end facing the central electrode, and an igniting portion secured to either the central electrode or to the ground electrode or to both for forming a spark discharge gap, wherein the igniting portion comprises a chip including a metal-oxide composite material including at least 10 wt % of Ir, an alloy having at least one element selected from a group consisting of Rh, Mo, Nb and Pt in a total amount in a range of 0.5 to 88.4 wt %, and a rare earth oxide in an amount ranging from 1.6 to 15 wt %.

18 Claims, 2 Drawing Sheets

SPARK PLUG WITH IGNITING PORTION CHIP COMPOSITION

This application claims the benefit of Japanese Patent Application No. Hei. 8-188349, filed Jun. 28, 1996, which is hereby incorporated by reference.

BACKGROUND OF THE INVENTION

1. Field of the Invention

The present invention relates to a spark plug with igniting portion chip composition for use in internal combustion engines.

2. Description of the Related Art

Conventional spark plugs used in internal combustion engines, such as automotive engines, have an igniting portion formed of a platinum (Pt) alloy chip welded to a tip end of an electrode in order to improve its resistance to spark consumption. However, in view of the high cost of platinum, it has been proposed to use less expensive iridium (Ir) as a chip material.

A problem with the use of Ir as a material for the igniting portion of the spark plug is that Ir easily oxidizes and evaporates in a high temperature range of 900 to 1,000° C. Therefore, if it is directly used in the igniting portion of the electrode, it is consumed by oxidation and evaporation to a greater extent than by sparking. In order to retard the oxidation and evaporation of Ir, it has been proposed that a material having a rare earth oxide, such as $Y_2O_3$, dispersed in Ir, should be used as added to the chip composition (See Unexamined Japanese Patent Publication (kokai) No. Hei. 7-37677). However, as recent engine models are designed to increase output power, the range of temperatures over which the spark plug is used tends to shift towards the higher end, and even the spark plug that uses a chip made of the proposed material may not have a satisfactory durability.

SUMMARY OF THE INVENTION

An object of the present invention is to provide a spark plug that is sufficiently resistant to consumption by oxidation and evaporation of an Ir component at elevated temperatures to thereby assure high durability.

A spark plug comprises, a central electrode, an insulator provided exterior to the central electrode; a metallic shell exterior to the insulator such and having the central electrode protrude from one end of the metallic shell, a ground electrode having one end coupled to the metallic shell and having another end facing the central electrode, and an igniting portion secured to either the central electrode or to the ground electrode or to both for forming a spark discharge gap, wherein the igniting portion comprises a chip including a metal-oxide composite material including at least 10 wt % of Ir, an alloy having at least one element selected from a group consisting of Rh, Mo, Nb and Pt in a total amount in a range of 0.5 to 89.9 wt % and a rare earth oxide in an amount ranging from 0.1 to 15 wt %.

The spark plug according to the present invention uses an Ir containing chip material but is sufficiently resistant to consumption by oxidation and evaporation of the Ir component at elevated temperatures to assure high endurance.

BRIEF DESCRIPTION OF THE DRAWINGS

In the accompanying drawings.

DETAILED DESCRIPTION OF THE INVENTION

Figure 1:
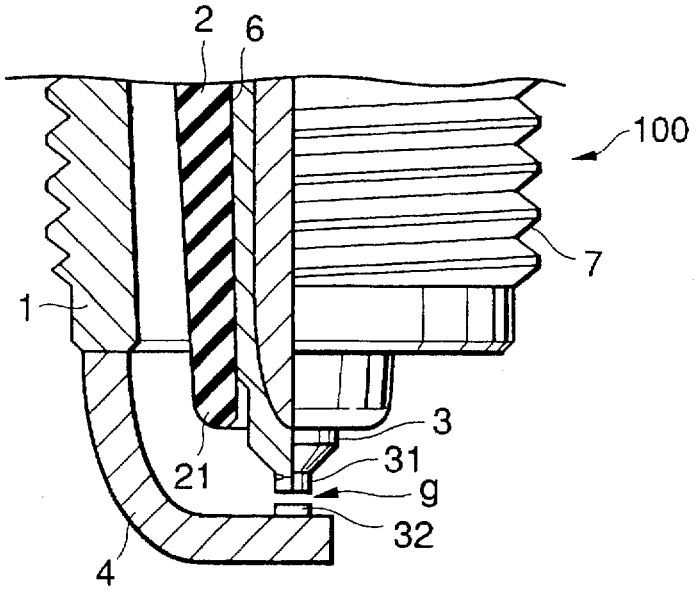
FIG. 1 is a partial front sectional view at the spark plug of present invention.

Detailed description of the present invention will be described as follows.

A spark plug according to the present invention has a central electrode, an insulator provided exterior to the central electrode, a metallic shell provided exterior to the insulator in such a way that the central electrode protrudes from one end, a ground electrode coupled at one end to the metallic shell and which has the other end said central electrode, and an igniting portion that is secured to either the central electrode or the ground electrode or both for forming a spark discharge gap. The igniting portion is composed of a chip made of a metal-oxide composite material that contains at least 10 wt % of Ir, which contains one or more of Rh, Mo, Nb and Pt in a total amount in the range of 0.5 to 89.9 wt %, preferably in the range of 0.5 to 20 wt %, more preferably 5 to 10 wt %, and which also contains a rare earth oxide in an amount in the range of 0.1 to 15 wt %.

If a chip made of the material set forth above is used to compose the igniting portion which forms a spark discharge gap, the consumption due to oxidation and evaporation of the Ir component at elevated temperatures is effectively retarded, resulting in a highly durable spark plug.

Among the composite material of which the chip is to be made, a group of elements Rh, Mo, Nb and Pt (hereunder referred to as "alloy components") and the rare earth oxide are each effective in retarding the oxidation and evaporation of the Ir component. If the Ir content is least than 10 Wt %, the melting point of the chip will drop to a level, where the desired durability can no longer be assured. Therefore, the sum of the alloy Components and the rare earth oxide should not exceed 90 wt %. The Ir amount is desirably at least 50 wt %.

If the total content of the alloy components is least than 0.5 wt %, the desired effectiveness of the addition of those alloy components in preventing the oxidation and evaporation of Ir can no longer be obtained. Therefore, the sum of the alloy components is preferably adjusted to be at least 0.5 wt %.

On the other hand, if the content of the rare earth oxide is less than 0.1 wt %, the desired effectiveness of the addition of the rare earth oxide in preventing the oxidation and evaporation of Ir can no longer be obtained. If the amount of the rare earth oxide exceeds 15 wt %, the resistance of the chip to thermal impact decreases to such a level that defects (such as cracking) may occur at some locations such as where the chip is secured to an electrode by welding. While $Y_2O_3$ is preferably used as the rare earth oxide, other compounds including $La_2O_3$ and $ThO_2$ may also be employed.

The alloy components are preferably contained in amounts not exceeding their solubility limits with respect to Ir. If either of the alloy components exceeds its solubility limit with respect to Ir, a brittle intermetallic compound forms between the two elements, and may occasionally impair the durability of the igniting portion against sparking or its resistance to thermal impact. For example, when using Mo or Nb as the alloy component, the solubility limit of Mo with respect to Ir is about 12 wt % at room temperature, whereas the solubility limit of Nb with respect to Ir is about 6 wt %, so if either Nb or Mo is to be added individually, their content may be set at a level smaller than the stated values. It should be noted, however, that if the amount with which the intermetallic compound is to be formed is below a certain level and expected to cause only small effects on the durability and other characteristics of the igniting portion, the content of Mo or Nb may safely exceed their solubility limits to a slight degree. Thus, the content of Mo, if it is to be added alone, is preferably 20 wt % or less, more preferably 12 wt % or less. Similarly, the content of Nb, if it is to be contained alone, is preferably 10 wt % or less, more preferably 6 wt % or less. Needless to say, both Mo and Nb may be added in the composite material, and in that case, the amount of Mo and Nb are desirably set not to exceed their solubility limits with respect to Ir in a ternary system of Ir-Mo-Nb.

Next, in the case of adding Rh as the alloy component, it the Rh amount exceeds 80 wt %, the melting point of the composite material will drop to such an extent that durability of the central electrode (or its igniting portion) reduced its. The Rh amount is desirably adjusted to lie within the range of 20 to 60 wt %, more desirably within the range of 30 to 40 wt %.

When adding Pt as the alloy component, the Pt amount is in the range of 0.5 to 40 wt %, preferably in the range of 2 to 30 wt %.

The composite material for the chip may be a sintered material, Thus has the advantage of forming a uniform dispersion of the rare earth oxide to achieve a further improvement in the durability of the igniting portion.

Several embodiments of the invention will now be described with reference to the accompanying drawings.

FIG. 1 shows an embodiment of the invention, in which a spark plug 100 has a tubular metallic shell 1, an insulator 2 fitted into the metallic shell 1 in such a way that the tip end 21 protrudes from the metallic shell 1, a central electrode 3 provided within the insulator 2 in such a way that the igniting portion 31 formed at the tip end protrudes form the insulator 2, and a ground electrode 4 coupled to one end to the metallic shell 1 by welding and that has the other end bent laterally such that its lateral side faces the tip end of the central electrode 3. The ground electrode 4 has an igniting portion 32 facing the igniting portion 31 of the central electrode 3; the clearance between the igniting portions 31 and 32 forms a spark discharge gap g.

The insulator 2 is a sinter of a ceramic material with alumina or aluminum nitride as a main component, and has an axial bore 6 through which the central electrode 3 is fitted. The metallic shell 1 is a cylindrical shape made of a metal, such as a low-carbon steel that provides a housing for the spark plug 100. The circumference of the shell 1 has a threaded portion 7 formed to assist in the mounting of the spark plug 100 on an engine block (not shown).

The main body 3*a* of the central electrode 3 and the main body 4*a* of the ground electrode 4 are both typically made of a Ni alloy, The igniting portion 31 of the central electrode 3 and the opposed igniting portion 32 of the ground electrode 4 are both composed of a chip made of a metal-oxide composite material that contains at least 10 wt % of Ir, which contains one or more of Rh, Mo, Nb and Pt in a total amount ranging form 0.5 to 89.9 wt % and which also contains a rare earth oxide such as $Y_2O_3$ in an amount ranging from 0.1 to 15 wt %. These chips may be formed from a sintered composite material obtained by providing an alloy powder consisting of Ir and the above-mentioned alloy components or a mixture of the powders of elemental metals in specified proportions, mixing such alloy powder or metal powders with a rare earth oxide powder to form a dispersion, shaping the dispersion into a compact and sintering the compact.

Alternatively, the chips may be formed of a molten material obtained by mixing the necessary alloy components and a rare earth oxide powder to give the stated formula and melting the mixture.

Figure 2:
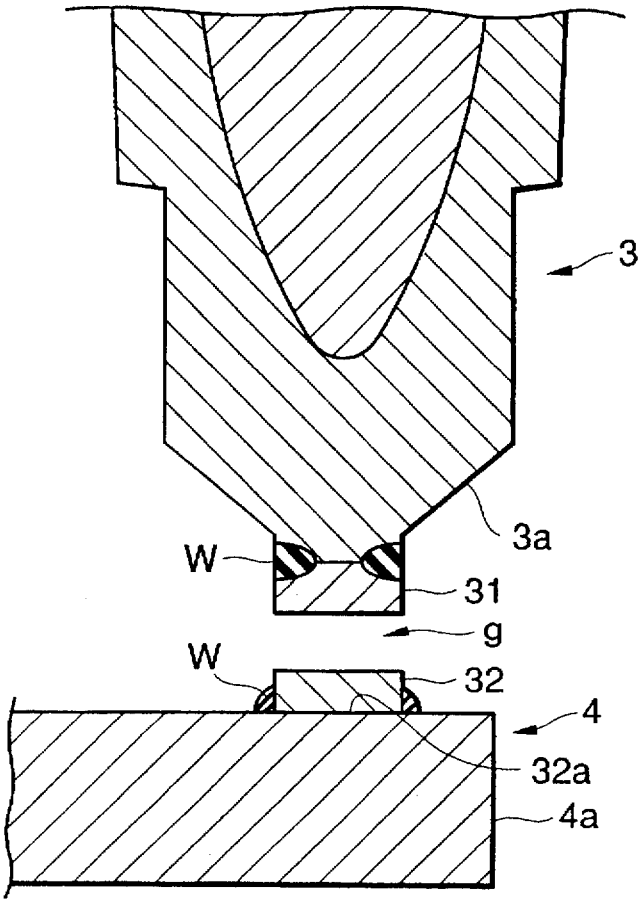
FIG. 2 is a sectional view showing an enlarged portion of the spark plug.

As shown in FIG. 2, the main body 3*a* of the central electrode 3 tapers at the tip end and its tip and face is formed flat. A disk-shaped chip having an alloy formula for the igniting portion 31 is placed on the flat tip end face and laser welding, electron beam welding, resistance welding or other suitable welding technique is applied to the periphery of the joined surfaces to form a weld line W, whereby the chip is securely fixed to the tip end face of the central electrode 3 to form the igniting portion 31. In order to form the opposed igniting portion 32, a similar chip is placed on the ground electrode 4 in registry with the position of the igniting portion 31 and a weld line W is similarly formed on the periphery of the joined surfaces, whereby the chip is securely fitted to the ground electrode 4 to form the igniting portion 32. If desired, either one of the two opposed igniting portions 31 and 32 may be omitted. In this case, the spark discharge gap is formed between the igniting portion 31 (or the opposed igniting portion 32) and the ground electrode 4 (or the central electrode 3).

The function of the spark plug 100 will be described as follows. The spark plug 100 is fitted on an engine block using the threaded portion 7 and used to ignite an air-fuel mixture supplied into the combustion chamber. The igniting portion 31 and the opposed igniting portion. 32 define the spark discharge gap g. Since both igniting portions 31, 32 are composed of chips made of the aforementioned alloy, their consumption due to the oxidation and evaporation of It is sufficiently retarded to ensure that the spark discharge gap g will not increase for a prolonged period, thereby extending the life of the spark plug 10C.

EXAMPLES

Figure 3:
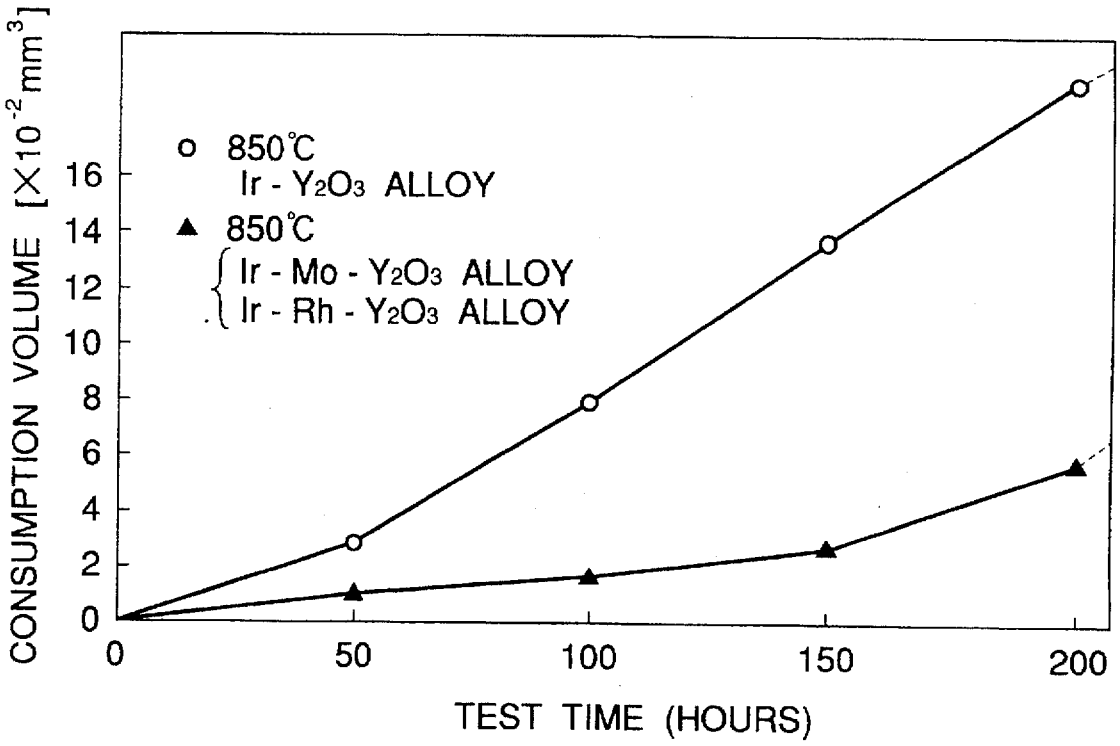
FIG. 3 is a graph showing a relationship between an engine operating time and a volume of chip consumption in the spark plug under test with chips of differing compositions.

Two Ir based alloy powders were tested, one containing 1 wt % of Mo and the other containing 5 wt % of Rh. Each powder was mixed with a $Y_2O_3$ powder. The mixtures were shaped into a predetermined shape and sintered to fabricate chips made of metal-oxide composite materials, one consisting of 1 wt % Mo, 1.7 wt % $Y_2O_3$ and the balance Ir, and the other consisting of 5 wt % Rh, 1.7 wt % $Y_2O_3$ and the balance Ir, A comparative chip was fabricated from a sintered composite material consisting of 1.7 wt % $Y_2O_3$ and the balance Ir. Each chip was used to form the igniting portion 31 of the spark plug 100 shown in FIG. 1 and the opposed igniting portion 32 (to provide a spark discharge gap g of 1.1 mn), and the individual plugs were subjected to a performance test under the following condition: a six-cylinder gasoline engine (piston displacement=2,000 cc) was fitted with the plug under test and operated at full throttle for 200 hours at a rotational speed of 6,000 rpm (with the temperature of the central electrode rising to about 850° C.); during engine operation, the volume of chip consumption was measured at specified time intervals, The results are shown in FIG. 3.

Obviously, the chip of the comparative plug experienced a marked consumption in terms of volume but this was not the case with the plugs within the scope of the invention.

What is claimed is:

1. A spark plug comprising:

a central electrode;

an insulator exterior to the central electrode;

a metallic shell exterior to the insulator and having the central electrode protrude from one end of the metallic shell;

a ground electrode having one end coupled to the metallic shell and having another end facing the central electrode; and an igniting portion secured to either the central electrode or to the ground electrode or to both for forming a spark discharge gap, wherein the igniting portion comprises a chip including a metal-oxide composite material including at least 10 wt % of Ir, an alloy having at least one element selected from a group of elements consisting of Rh, Mo, Nb and Pt in a total amount in a range of 0.5 to 88.4 wt %, and a rare earth oxide in an amount ranging from 1.6 to 15 wt %.

2. The spark plug according to claim 1, wherein the rare earth oxide is $Y_2O_3$.

3. The spark plug according to claim 1, wherein a sum of an amount of Ir, an alloy including at least one of Rh, Mo and Nb, and the rare earth oxide is not more than 90 wt %, with a remainder including Pt.

4. A spark plug comprising:

a central electrode;

an insulator exterior to the central electrode;

a metallic shell exterior to the insulator and having the central electrode protrude from one end of the metallic shell;

a ground electrode having one end coupled to the metallic shell and having another end facing the central electrode; and an igniting portion secured to either the central electrode or to the ground electrode or to both for forming a spark discharge gap, wherein the igniting portion comprises a chip including a metal-oxide composite material including at least 50 wt % of Ir, an alloy having at least one element selected from a group of elements consisting of Rh, Mo, Nb and Pt in a total amount in a range of 0.5 to 49.9 wt %, and a rare earth oxide in an amount ranging from 0.1 to 15 wt %.

5. The spark plug according to claim 4, wherein the metal-oxide composite material includes the elements in amounts not exceeding solubility limits of the elements with respect to Ir.

6. The spark plug according to claim 4, wherein the metal-oxide composite material includes Mo in an amount in a range of 0.5 to 20 wt %.

7. The spark plug according to claim 6, wherein an amount of Mo is not more than 12 wt %.

8. The spark plug according to claim 4, wherein the metal-oxide composite material includes Nb in an amount in a range of 0.5 to 10 wt %.

9. The spark plug according to claim 8, wherein an amount of Nb is not more than 6 wt %.

10. The spark plug according to claim 4, wherein the metal-oxide composite material includes Rh in an amount ranging from 0.5 to 49.9 wt %.

11. The spark plug according to claim 10, wherein an amount of Rh is in a range of 20 to 49.9 wt %.

12. The spark plug according to claim 11, wherein an amount of Rh is in a range of 30 to 40 wt %.

13. The spark plug according to claim 4, wherein the rare earth oxide is $Y_2O_3$.

14. The spark plug according to claims 4, wherein the metal-oxide composite material includes a sintered material.

15. The spark plug according to claim 4, wherein an amount of Ir is not more than 90 wt %.

16. The spark plug according to claim 4, wherein a sum of an amount of Ir, an alloy including at least one of Rh, Mo and Nb, and the rare earth oxide is not more than 90 wt %, with a remainder including Pt.

17. The spark plug according to claim 4, wherein an amount of Pt is in a range of 0.5 to 40 wt %.

18. The spark plug according to claim 17, wherein an amount of Pt is in a range of 2 to 30 wt %.

* * * * *